United States Patent [19]

Powis

[11] Patent Number: 4,995,207

[45] Date of Patent: Feb. 26, 1991

[54] AIR-VAPOR BARRIER CONTINUITY DEVICE

[76] Inventor: William L. Powis, 1304 13th Street North, Lethbridge, Alberta, Canada, T1H 2T9

[21] Appl. No.: 434,071

[22] Filed: Nov. 14, 1988

Related U.S. Application Data

[63] Continuation of Ser. No. 884,543, Jul. 11, 1986, abandoned.

[51] Int. Cl.[5] ..... E06B 1/04
[52] U.S. Cl. ..... 52/210
[58] Field of Search ..... 52/210, 204

[56] References Cited

U.S. PATENT DOCUMENTS

| | | | |
|---|---|---|---|
| 1,082,375 | 12/1913 | Vachon | 52/58 |
| 1,798,839 | 3/1931 | Gross | 52/276 |
| 2,292,301 | 4/1942 | Smith | 52/210 |
| 2,586,102 | 2/1952 | Smith | 52/210 |
| 3,609,928 | 10/1971 | Mock | 52/210 |

FOREIGN PATENT DOCUMENTS

| | | |
|---|---|---|
| 904529 | 11/1972 | Canada . |
| 1091886 | 12/1980 | Canada . |

*Primary Examiner*—James L. Ridgill, Jr.
*Attorney, Agent, or Firm*—William R. Hinds; George H. Dunsmuir

[57] ABSTRACT

An air-vapor barrier continuity device for installation across an airspace between a window (or door jamb) and a wall stud (or rough sill) so as to provide an air-vapor barrier across the airspace. The continuity device comprises a flexible first generally rectangular longitudinal planar member and a second generally rectangular longitudinal line of the second member. The angle between the first and second members is greater than 90° to provide biased contact with the wall stud or rough sill. The second member attaches to a door (or window) jamb at the inner wall surface of the jamb. The first member is of sufficient breadth to extend from the jamb across the airspace to the first wall stud (or rough sill) adjacent the air space. Preferably, the continuity device is extruded from a polymeric material as a single sheet bent along a longitudinal line, one side forming the first member and the other side forming the second member.

14 Claims, 3 Drawing Sheets

AIR-VAPOR BARRIER CONTINUITY DEVICE

This is a continuation of application Ser. No. 884,543 filed July 11, 1986, now abandoned.

FIELD OF THE INVENTION

The present invention relates to a device for use in wall construction around windows and doors and more particularly to a device for providing an air-vapour barrier across an airspace around a window or door jamb.

BACKGROUND OF THE INVENTION

In order to ensure the fitting of doors and windows during the construction (or reconstruction) of building walls, it is usual to make a larger opening than required for the door or window jamb (frame) thereby leaving an airspace between the jamb and the internal wall studs and insulation (if any). This airspace undesirably provides an air/vapour passageway from the outside of the building to the inside of the building. Therefore, while the airspace is necessary for the installation of the door (or window) it provides an insulation problem once the door has been installed.

In accordance with modern construction practices, it is also usual to apply an air-vapour barrier sheet, in the form of a plastic sheet (e.g. polyethylene) over the wall studs (and insulation) and below the interior wall cladding (e.g. gypsum board) to prevent outside air and moisture from passing through the wall to the cladding and the interior of the building and to prevent interior moisture and air from passing into the wall cavity and outside. Such vapour-barrier- sheet-.may be stapled to the wall studs to secure it during the construction phase. Since it is awkward to affix the air-vapour barrier sheet to a window (or door) jamb, it is ordinarily only run over the length of the wall studs/insulation to the start of the airspace thereby leaving a gap across the airspace through which air and vapour may pass. Consequently, it is desirable to provide a means by which the airspace between a window or door jamb and the interior wall studs/insulation and air-vapour barrier sheet (if any) may isolate the exterior from the interior of the building.

SUMMARY OF THE INVENTION

In accordance with the invention, there is provided an air-vapour barrier continuity device for installation across an airspace between a door or window jamb and a wall stud or rough sill. The continuity device comprises a flexible first generally rectangular longitudinal planar member and a second generally rectangular longitudinal planar member connected thereto. The first member angularly connects at a first back longitudinal edge thereof to the second member along a longitudinal line of the second member. The first member extends away from a front longitudinal edge of the second member at an angle greater than 90° to provide biased contact with the wall stud or rough sill upon installation whereupon the second member lies adjacent an inner wall edge of the jamb. The breadth of the first member is sufficient to extend from the jamb across the airspace to the wall stud or rough sill.

Preferably, the air-vapour barrier continuity device is formed as a single rectangular sheet of a polymeric material, bent along a longitudinal line thereof, such that one side forms the first member of the device and the second side forms the second member. The angle between the first and second members is preferably in the order of 95°-110°.

The air-vapour barrier continuity device of the present invention provides an effective and easy-to-install means of "damming" an airspace around windows and doors. It may be used with or without an air-vapour barrier sheet while still providing a barrier across the airspace. Each end of the device seals effectively on either side of the airspace, the first end (i.e. the first member) being configured to be securely biased against the first wall stud (or rough sill) adjacent the airspace and the second end (i.e. the second member) being configured to be secured to the door jamb.

DESCRIPTION OF THE DRAWINGS

A preferred embodiment of the invention is described in greater detail below with reference to the following drawings in which like reference numerals refer to like parts throughout.

DETAILED DESCRIPTION OF A PREFERRED EMBODIMENT

Figure 1:
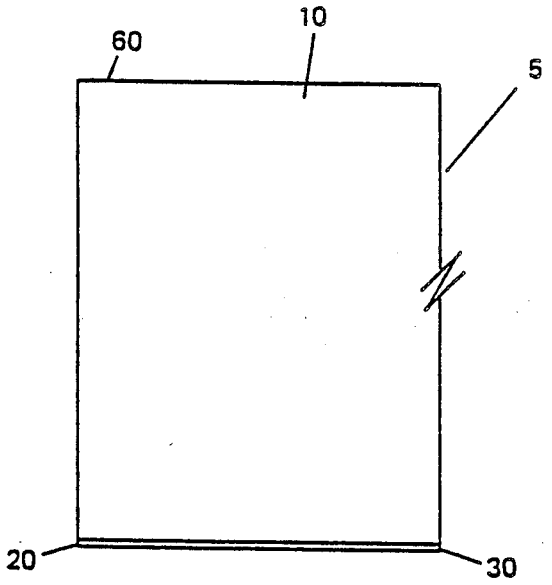
FIG. 1 shows a front view of an air-vapour barrier continuity device in accordance with the present invention.
Figure 2:
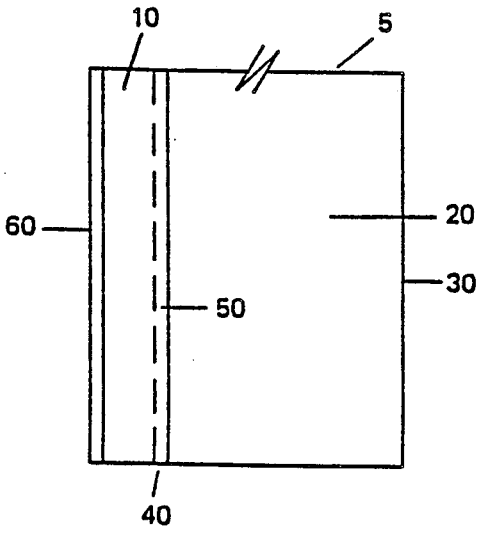
FIG. 2 shows a plan (i.e. top) view of the air-vapour barrier continuity device of FIG. 1.
Figure 3:
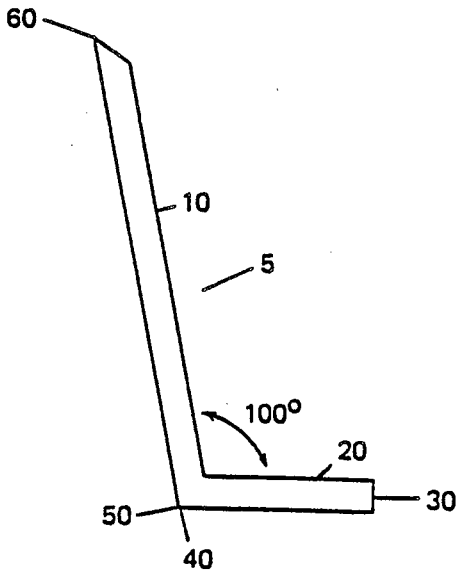
FIG. 3 shows a side view of the air-vapour barrier continuity device FIG. 1.

FIGS. 1, 2 and 3 of the drawings illustrate a preferred embodiment of the invention. FIG. 1 shows a front view of an air-vapour barrier continuity device 5 and FIGS. 2 and 3 show the plan and side views, respectively. FIGS. 2 and 3 do not indicate a specific length of the continuity device; it may be manufactured in a variety of lengths as desired, for example, 10 foot sections which may then be cut to the appropriate length for any specific application.

As illustrated, a flexible first generally rectangular longitudinal planar member 10 angularly connects at a first back longitudinal edge 50 thereof to a second generally rectangular longitudinal planar member 20 at an angle greater than 90°. The greater-than-90° angular connection provides a close-fitting biased contact of the first member to the wall stud when the continuity device 5 is installed. The connection of the first member 10 to the second member 20 is along a longitudinal line 40 of the second member 20, the longitudinal line 40 being coincident with the second back longitudinal edge of the second member 20 in the illustrated embodiment.

The preferred air-vapour barrier continuity device is integrally formed as a flexible generally rectangular longitudinal polymeric (e.g. polyethylene) sheet bent along a longitudinal line thereof such that one side forms the first member 10 and the other side forms the second member 20. The angle of the bend is greater than 90° and is preferably 100° as shown in FIG. 3. The method of manufacture of the illustrated continuity device 5 is according to standard profile extrusion methods of making such polymeric piece items.

Figure 4:
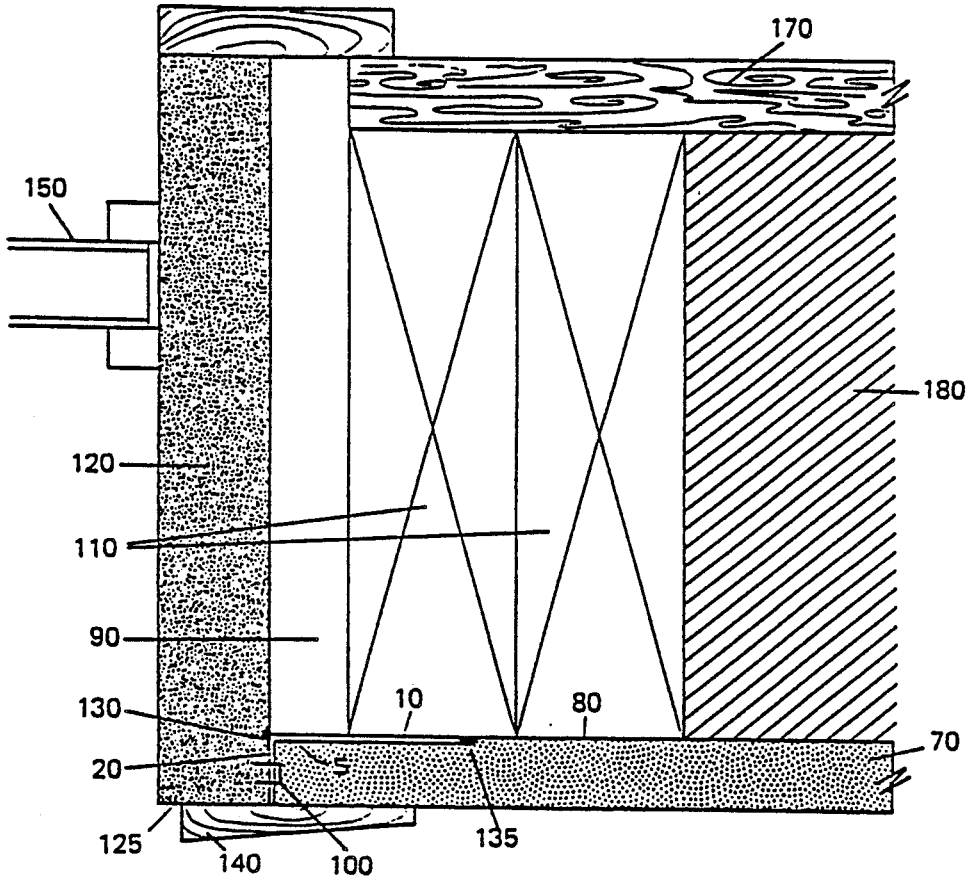
FIG. 4 is a sectional plan view of a window-to-wall construction from the exterior to interior walls showing an air-vapour continuity device in accordance with the invention installed between the window jamb and a wall stud.
Figure 5:
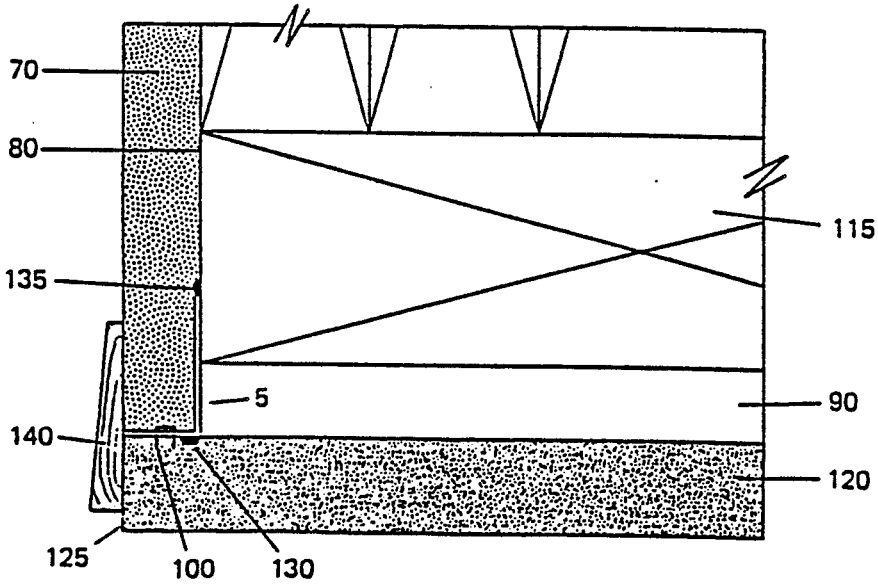
FIG. 5 is a sectional side view of a window-to-wall construction at the top of a window showing an air-vapour barrier continuity device in accordance with the invention installed between the jamb and the top rough sill.

The continuity device 5 is installed during the construction (or reconstruction) of a wall before the air-vapour barrier sheet 80 and interior wall cladding 70 are installed (but after the exterior wall 170, the door or window 150, the wall studs 110, the rough sill 115 and/or the insulation 180 have been installed). As shown in FIGS. 4 and 5, to install the continuity device 5, the second member 20 is affixed to the inner wall edge of the door jamb (i.e. at the end of the jamb adjacent the interior wall section to be clad with wall cladding 70). To fix the second member to the jamb, it may be stapled 100 and/or caulked 130 (with a suitable sealant) as shown in the drawings depending upon the materials of the jamb and continuity device.

The first member 10 is of sufficient breadth to extend from the jamb across the airspace 90 to the first wall stud 110 (or rough sill 115) adjacent the airspace 90. The second member 20 is positioned on the jamb 120 such that the first member 10 extends away from the jamb 120 a suitable distance inwardly from the interior face 125 of the jamb that the wall cladding 70 may be installed over the continuity device 5 as shown. For a standard window jamb installation, the breadth of the first and second members 10, 20 of the continuity device 5 and the positioning of the same is roughly as shown in FIGS. 4 and 5 (i.e. the wall cladding 70 being ½" thick and the first and second members 10, 20 being 1½" and ½" broad, respectively). However, the appropriate dimensions for any given application may be readily perceived by a technician desirous to use the invention.

Figure 6:
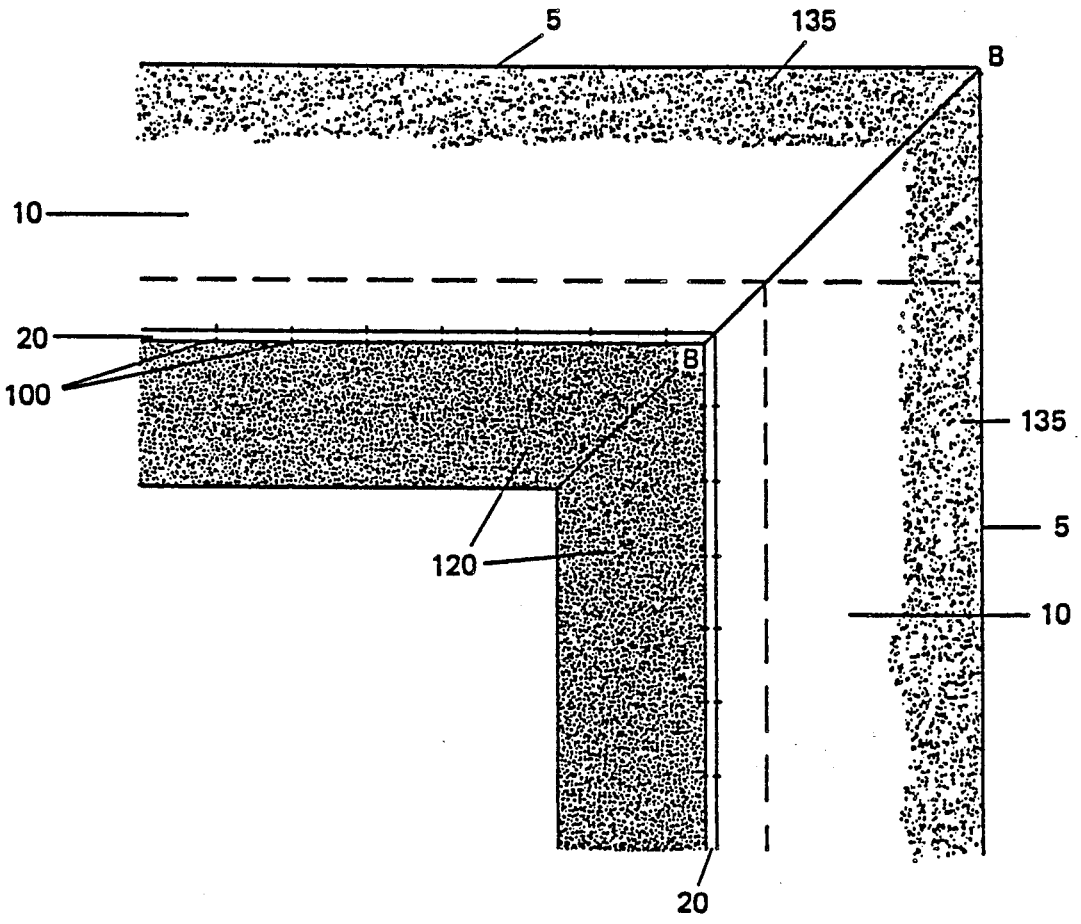
FIG. 6 is a front view of an upper right-hand side corner of a window in which two air vapour-barrier continuity device sections in accordance with the invention are installed and joined together at the corner along line B—B.

At the corner locations of the window (or door), two sections of the continuity device 5 along the top and side of the window (or door) are trimmed during installation to 45° angles so that they match at the corner as shown in FIG. 6. To achieve good matching at the corners, the devices 5 are let to overhang each other at the corner a distance approximately equal to the breadth of the first members 10 of each device 5, clipping off the ends of the second members 20 as required to achieve this overlap. Once this is done there are two thicknesses of first members 10 overlapping at the corner section. These are then cut along line B—B shown in FIG. 6 using a straight edge, cutting outwardly from the corner. The resulting 45° cut of the two continuity device sections 5 will match to provide a flush corner join which can then be caulked using an appropriate sealant to join the two sections along the 45° line B—B.

Once all sections of the continuity device 5 have been installed around the window or door, a waterproof air-vapour barrier sheet 80 may be caulked (i.e. sealingly attached) to and around the perimeter of the continuity device using an appropriate sealant 135 as shown in FIGS. 4, 5 and 6 to provide a continuous air-vapour barrier from the sheet 80 to the jamb 120. The interior wall cladding 70 and window or door trim 140 may then be installed in the conventional manner.

The above description of a preferred embodiment of the continuity device of the invention is not intended to limit the scope of the invention. Configurations and materials of the continuity device, though different than those specified above in connection with the preferred embodiment, may nevertheless fall within the scope of the invention which is defined by the appended claims. For example, instead of a generally L-shaped configuration, a generally T-shaped configuration might instead be elected. Similarly, there are a variety of materials and sizes other than those described above which might be suitably elected.

I claim:

1. An air-vapour barrier continuity device for installation across an airspace between a door or window jamb and a wall stud or rough sill, said device comprising a flexible first generally rectangular longitudinal planar member and a second generally rectangular longitudinal planar member, said first member angularly connected at a first back longitudinal edge thereof to said second member along a longitudinal line of said second member whereby said first member extends away from a front longitudinal edge of said second member at an angle greater than 90° to provide biased contact with said wall stud or rough sill upon installation, said second member to be positioned adjacent the inner wall edge of said jamb.

2. A device according to claim 1, wherein said first and second members are integrally formed as a flexible generally rectangular longitudinal sheet bent along a longitudinal line thereof, a first side from said line forming said first member and a second side from said line forming said second member.

3. A device according to claim 2, wherein said sheet is comprised of a polymeric material.

4. A device according to claim 2, wherein said angle is in the range 95°–110°.

5. A device according to claim 3, wherein said angle is in the range 95°–110°.

6. A device according to claim 5, wherein said angle is approximately 100°.

7. In a wall construction around a door or window jamb between the jamb and a wall stud or rough sill, and over and across an airspace between the same, the improvement comprising an air-vapour barrier continuity device, said device comprising a flexible first generally rectangular longitudinal planar member and a second generally rectangular longitudinal planar member, said first member angularly connected at a first back longitudinal edge thereof to said second member along a longitudinal line of said second member whereby said first member extends away from a front longitudinal edge of said second member at an angle greater than 90° to provide biased contact with said wall stud or rough sill, said second member positioned adjacent the inner wall edge of said jamb, the breadth of said first member being sufficient to extend from said jamb across said airspace to said wall stud or rough sill.

8. The improvement of claim 7, wherein said first member of said continuity device is sealingly attached to a waterproof air-vapour barrier sheet positioned over said wall stud or rough sill forming a continuous air-vapour barrier from said sheet to said jamb.

9. The improvement of claim 8, wherein said first and second members of said continuity device are integrally formed as a flexible generally rectangular longitudinal sheet bent along a longitudinal line thereof, a first side from said line forming said first member and a second side from said line forming said second member.

10. The improvement of claim 9, wherein said angle is in the range 95°–110°.

11. The combination comprising:

(a) a window or door jamb;

(b) a wall stud or rough sill adjacent said jamb, an airspace being between said jamb and said wall stud or rough sill;

(c) an air-vapour barrier continuity device between said jamb and said wall stud or rough sill, said continuity device comprising a flexible first generally rectangular longitudinal planar member and a second generally rectangular longitudinal planar member, said first member angularly connected at a first back longitudinal edge thereof to said second member along a longitudinal line of said second member whereby said first member extends away from a front longitudinal edge of said second member at an angle greater than 90° providing biased contact with said wall stud or rough sill, said second member positioned adjacent the inner wall edge of said jamb, said first member extending from said jamb across said airspace to said wall stud or rough sill.

12. The combination of claim 11 further comprising a waterproof air-vapour barrier sheet positioned over said wall stud or rough sill and sealingly attached to said first member of said continuity device forming a continuous air-vapour barrier from said sheet to said jamb.

13. The combination of claim 12, wherein said first and second members of said continuity device are integrally formed as a flexible generally rectangular longitudinal sheet bent along a longitudinal line thereof, a first side from said line forming said first member and a second side from said line forming said second member.

14. The combination of claim 13, wherein said angle is in the range 95°–110°.

* * * * *